US007527582B2

(12) United States Patent
Januszek

(10) Patent No.: US 7,527,582 B2
(45) Date of Patent: May 5, 2009

(54) EXERCISE DEVICE

(75) Inventor: Richard Zdzislaw Januszek, Yaxley (GB)

(73) Assignee: Escape Fitness Limited, Hampton, Peterborough (GB)

( * ) Notice: Subject to any disclaimer, the term of this patent is extended or adjusted under 35 U.S.C. 154(b) by 145 days.

(21) Appl. No.: 11/627,472

(22) Filed: Jan. 26, 2007

(65) Prior Publication Data

US 2007/0197354 A1 Aug. 23, 2007

(30) Foreign Application Priority Data

Feb. 18, 2006 (GB) ..... 0603282.5

(51) Int. Cl.
*A63B 21/072* (2006.01)

(52) U.S. Cl. ..... 482/108; 482/107

(58) Field of Classification Search ..... 482/50, 482/92–94, 97, 98, 106–109; 473/256, 437
See application file for complete search history.

(56) References Cited

U.S. PATENT DOCUMENTS 675,314 A * 5/1901 Abenheim ..... 482/108
793,101 A * 6/1905 Schmidt ..... 482/108
850,964 A * 4/1907 Pelletier et al. ..... 482/108
1,044,018 A * 11/1912 Calvert ..... 482/108
1,138,196 A * 5/1915 Diehl ..... 482/106
1,991,520 A * 2/1935 Postl ..... 482/108
2,719,038 A * 9/1955 Massa ..... 482/82
3,488,051 A * 1/1970 Papistas-Scherer ..... 482/108
5,407,413 A * 4/1995 Kupferman ..... 482/106
5,628,716 A * 5/1997 Brice ..... 482/106
6,319,176 B1 * 11/2001 Landfair ..... 482/93
6,602,169 B1 * 8/2003 Patti ..... 482/107
6,875,161 B1 * 4/2005 Brice ..... 482/107
7,048,678 B2 * 5/2006 Harms et al. ..... 482/107
7,131,938 B2 * 11/2006 Cao ..... 482/106
2003/0232705 A1 12/2003 Harms et al.
2004/0072662 A1 * 4/2004 Landfair ..... 482/106
2007/0249475 A1 * 10/2007 Cao ..... 482/107
2008/0108483 A1 * 5/2008 Fife ..... 482/108

FOREIGN PATENT DOCUMENTS

DE 20014870 U1 * 12/2000
GB 498994 A * 1/1939
GB 2397254 A 7/2004
GB 2410197 A 7/2005

* cited by examiner

*Primary Examiner*—Loan H Thanh
*Assistant Examiner*—Victor K Hwang
(74) *Attorney, Agent, or Firm*—Richard M. Goldberg

(57) ABSTRACT

An exercise device comprising a bar, a weight assembly, an end plate and a securing member. The bar comprises an end portion onto which the weight assembly is mounted. The securing member co-operates with the end plate to secure the weight assembly to the end portion of the bar. The end plate is rotationally fixed relative to the weight assembly to mitigate against loosening of the securing member during use.

20 Claims, 4 Drawing Sheets

EXERCISE DEVICE

BACKGROUND OF THE INVENTION

The present invention relates to an exercise device, particularly but not exclusively to a dumbbell or barbell for weight lifting exercises and other fitness activities.

Conventional dumbbells or barbells comprise a bar and a set of weights mounted on the end portions of the bar. These dumbbells or barbells further comprise flanges and collars to retain the weights in position on the bar and to secure the weights. The flanges are provided on the bar towards the end portions. The collars are located on the end portions of the bar, over the weights, and are used to secure the weights on the bar by cooperating with the flanges to secure the weights therebetween.

These dumbbells or barbells have the problem that, through repeated use, the collars can become loose, thereby causing the weights to rotate, wobble and vibrate around the handle during use. This results in the dumbbell becoming awkward to use, and can eventually cause the weights to become disconnected from the bar, which can be extremely hazardous to the user.

Prior art patent GB2410197 addresses this problem by providing a dual fixing mechanism. The dumbbell of GB2410197 is provided with first and second securing members for securing the weight assembly to the end portion of the bar. The first securing member is a locking nut, which co-operates with a threaded portion on the bar, to force the weight against a flange section.

The second securing member comprises an end plate which engages with the weight. The end plate sits over the weight, and is held in place by means of a mounting screw, which engages with an internal thread in the end portion of the bar.

However, it has been noted that this fixing mechanism may still loosen in use due to the manner in which the dumbbells are treated by the user. In use, dumbbells are frequently dropped to the floor by their users, and will often land on their ends. It has been observed that the forces exerted by such a dropping action can result in excessive lateral, and rotational movement of the end plate, which in turn results in loosening of the securing members.

SUMMARY OF THE INVENTION

The present invention aims to provide a dumbbell end cap securing system which obviates or at least mitigates the above described problems and/or to provide improvements generally.

According to the present invention, there is provided an exercise device as defined in any of the accompanying claims.

In an embodiment of the invention, there is provided an exercise device comprising a bar, a weight assembly, an end plate and a securing member. The bar comprises an end portion onto which the weight assembly is mounted. The securing member co-operates with the end plate to secure the weight assembly to the end portion of the bar. The end plate is rotationally fixed relative to the weight assembly to mitigate against loosening of the securing member during use.

Preferably, the weight assembly comprises a recess which is adapted to receive the end plate. The end plate is inserted into the recess, and the shape of the end plate and the recess are selected such to prevent relative rotational movement between the end plate and the weight assembly. The recess also acts to limit relative lateral movement between the end plate and the weight assembly.

The shape of the recess and the end plate are selected such that at least part of the peripheral edge of the end plate engages with at least part of the inner edge of the recess to prevent rotation therebetween. Preferably, the shape of the recess and the end plate are chosen such that the outer profile of the end plate and the inner profile of the recess are the same.

In a preferred embodiment, the end plate comprises a first engagement element, and the weight assembly comprises a second engagement element corresponding to the first engagement element. The first and second engagement elements engage in use to prevent relative rotation between the end plate and the weight assembly. Preferably, the weight assembly comprises a recess adapted to at least partially receive the end plate, with the shape of the end plate defining the first engagement element, and the shape of the recess defining the second engagement element.

Preferably the first engagement element comprises at least a portion of the end plate, and the second engagement element comprises at least a portion of the recess.

In an embodiment of the invention, the outer profile of the end plate and the inner profile of the recess are the same.

In another embodiment, the first engagement element comprises at least one projection and the second engagement element comprises at least one receiving section corresponding to the projection. Preferably, the at least one projection is integral with the end plate. The at least one projection is also preferably a radial projection. The projections preferably extend radially from the periphery of the end plate, in a direction parallel to the upper surface of the weight assembly.

In an alternative arrangement, for example where the projection is a spigot, the projection may extend axially relative to the weight assembly.

In another embodiment, the end plate may comprise at least one radial projection and at least one axial projection.

In a preferred embodiment of the invention, the end plate is formed such that the at least one projection is integral to the end plate. The end plate may be formed of a single material, or preferably may comprise a load plate and an end plate outer skin. The load plate provides the load bearing structural integrity of the end plate. The load plate can be formed of steel or any other suitable load bearing material. The end plate outer skin is moulded over the load plate.

The load plate may be formed to comprise the projection, which is then over moulded by the end plate outer skin. Alternatively, and more preferably, the load plate is formed without a projection, and the projection subsequently is formed during the moulding process from the end plate outer skin alone. This is advantageous, as it is simpler to form the projection shape by moulding, rather than forming the projection by machining the load plate.

The receiving section corresponding to the projection of the end plate is preferably formed by the recess of the weight assembly. The shape of the recess corresponds to the shape of the end plate, or at least to the shape of the projection. Similarly to the end plate, the weight assembly comprises a weight section and an outer skin. The outer skin is moulded over the weight section. Preferably, the recess, including the receiving section, is formed in the outer skin during the moulding process. Moulding both the receiving section and the key seat enables the shape of both to be closely controlled to provide a tight tolerance therebetween.

Preferably, the end plate is circular, to correspond with the circular shape of the end surface of the weight assembly. The end plate comprises an end plate main body section and at least one projection. The main body section has a first diameter, with the at least one projection having a second diameter, the second diameter being greater than the first diameter.

In another embodiment of the invention, the end plate comprises a pair of projections defining the first engagement element. Preferably, the projections are radially opposed. The recess comprises a pair of corresponding receiving sections defining the second engagement element.

In an alternative embodiment, the end plate comprises at least one spigot, projecting from its lower surface. The weight assembly comprises at least one aperture corresponding to the at least one spigot of the end plate. The at least one spigot is received by the at least one aperture to prevent relative rotation between the end plate and the weight assembly. The aperture may be formed in the upper surface of the weight assembly by machining of the weight assembly. Alternatively, the weight assembly may comprise a weight section and an over moulded outer skin, with the aperture being formed in the outer skin during moulding.

In another embodiment, the end plate comprises an upper section and a lower section. The lower section is received by the recess and the upper section sits above the upper surface of the weight assembly. Preferably, the profile of the upper section and the lower section are the same. Alternatively, the upper section of the end plate may have a profile which varies from the profile of the lower section. In this way, the lower section may be shaped to prevent relative rotation between the end plate and the weight assembly, while the shape of the upper section is selected to enhance the visual appearance of the end plate.

In a further embodiment of the invention, the end plate is keyed to the recess. The key member prevents relative rotational movement between the end plate and the weight assembly. The lower section of the end plate, and the weight assembly both comprise key seats which correspond to the key member of the end plate. Preferably the key member is obscured from view and secured in position by the upper end plate section.

In another embodiment there is provided an exercise device comprising a bar comprising an end portion; a weight assembly mounted on the end portion; an end plate; a first securing member; and a second securing member. The first securing member co-operates with the end plate to secure the weight assembly to the end portion, and the second securing member secures the weight assembly to the end portion independently of the first securing member and the end plate. In this embodiment the end plate provides the additional advantage of obscuring the second securing member from view.

In another embodiment, the end plate may be prevented from rotating relative to the weight assembly by a third securing member. The third securing member may be a screw member. The screw member is radially offset from the first securing member. The screw member is passed through a second aperture in the end plate and received by a corresponding threaded aperture in the weight assembly.

In a further embodiment, there is provided a weight assembly for mounting on a bar. The weight assembly comprises a weight and an end plate. The end plate is adapted to be secured to the bar by a securing member, to secure the weight to the bar. The end plate is rotationally fixed relative to the weight assembly, to prevent loosening of the securing member when a rotational force is applied to the end plate.

BRIEF DESCRIPTION OF THE DRAWINGS

The invention will now be further illustrated by reference to the accompanying drawing in which.

DETAILED DESCRIPTION

Figure 1:
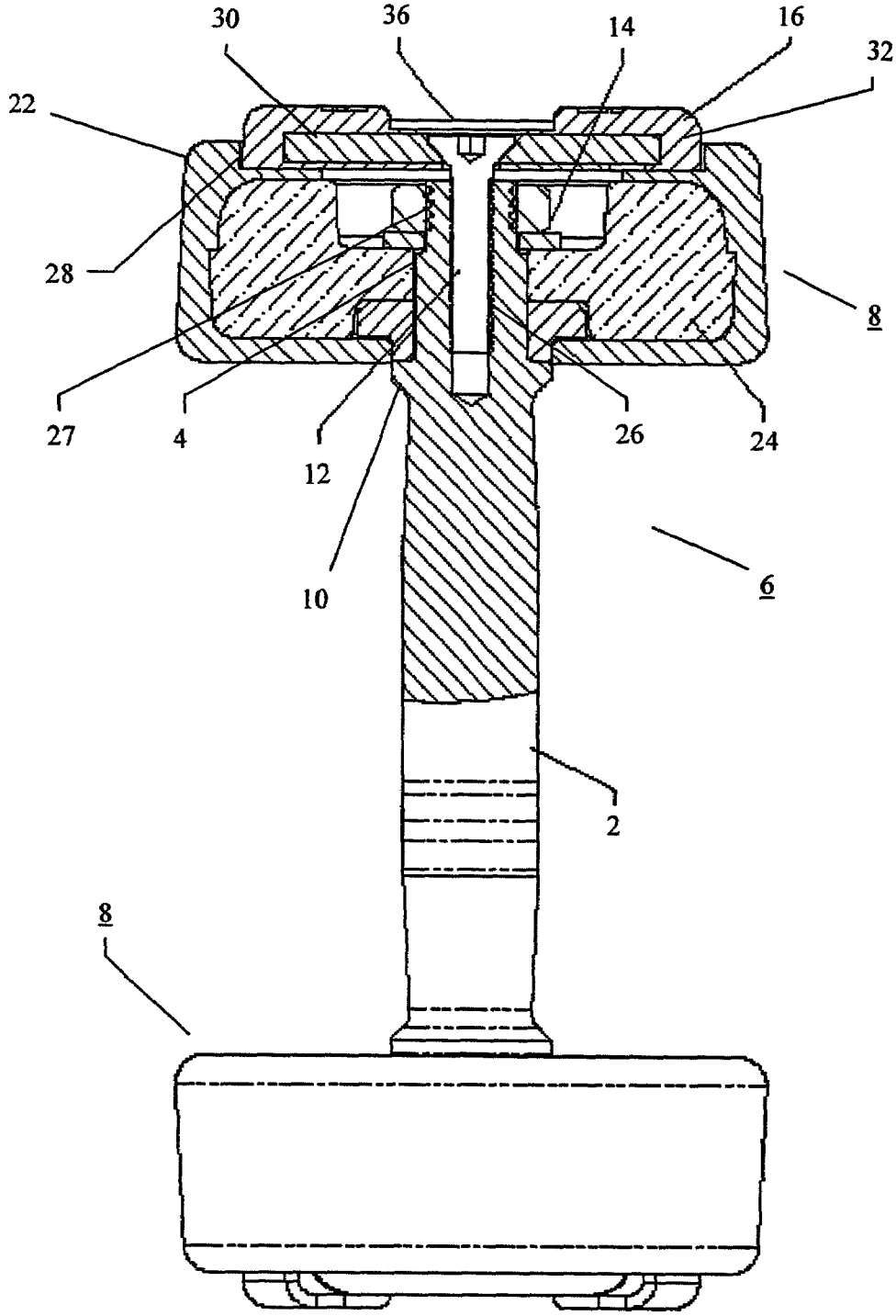
FIG. 1 presents a combined diagrammatic cross-sectional/side view of an exercise device according to an embodiment of the invention.

Referring to FIG. 1, the exercise device 6 comprises a bar 2 having end portions 4 on each end of the bar 2. The device 6 further comprises two weight assemblies 8 which are mounted on the end portions 4 of the bar 2. The weights 8 are retained on the end portions 4 by locating members 10. The locating members 10 may be projections or collars. The weight assemblies 8 comprise an inner weight section 24, and an outer skin 22.

The weights 8 are secured on the bar 2 by a first securing member 12 and an end plate 16, which can also be used to enhance the appearance of the dumbbells and obscure any secondary fixings from view. The first securing member 12 is a threaded fastener such as a mounting screw. The first securing member 12 engages with the internal threaded section 26 of the end portion 4 of the bar 2. The end plate 16 comprises a central aperture 35, defined and surrounded by a frustoconical wall 34, which is adapted to receive the first securing member 12. The threaded portion of the mounting screw 12 passes through the aperture 35 of the end plate 16, and is threaded into the end portion 4 of the bar 2. The head of the mounting screw 12 engages with the end plate 16. Thus, as the mounting screw 12 is tightened, it urges the end plate 16 against the weight assembly 8, thereby urging the weight assembly 8 against the projection 10. In this way, the weight assembly 8 is clamped between the end plate 16 and the projection 10, and is thereby secured to the end portion 4 of the bar 2.

The dumbbell 6 also comprises a second securing member 14. The second securing member 14 comprises a locking nut which engages with the threaded section 27 of the end portion 4 of the bar 2. The locking nut 14 provides a second clamping force, to retain the weight assembly 8 retained on the end portion 4 bar 2 between the locking nut 14 and the projection 10. It will be appreciated that the first 12 and second 14 securing members operate independently of each other. The weight assembly 8 could be retained on the bar 2 by the first securing means 12 alone.

Figure 7:
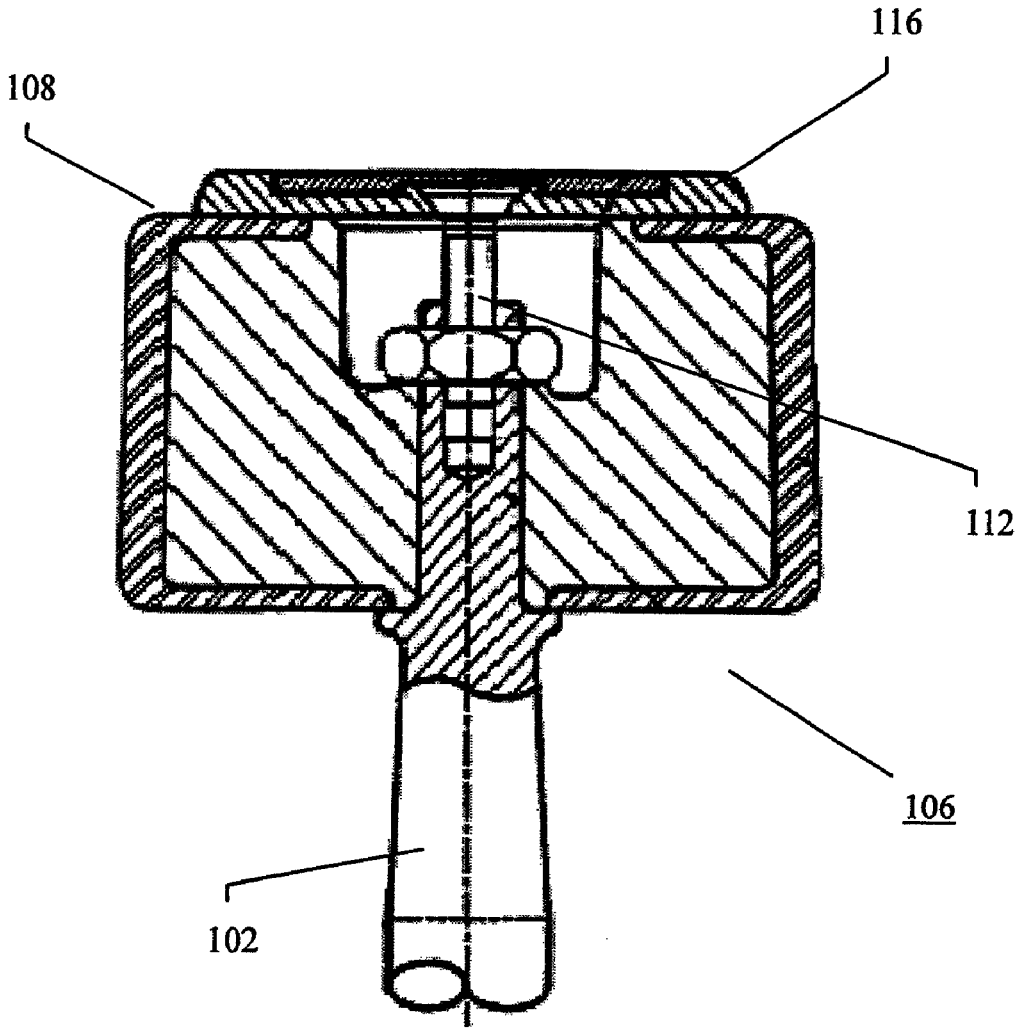
Fig 7 PRIOR ART
FIG. 7 presents a cross sectional view of the exercise device of prior art document GB2410197.

It has however been observed that when dumbbells having an end plate are dropped, rotational and lateral forces are exerted on the end plate. In the arrangement of GB2410197, as shown by way of example in FIG. 7, the end plate 116 sits flush upon the upper surface of the weight assembly 108. This is a common arrangement for dumbbells having end plates. In the arrangement of GB2410197, the rotational and lateral forces resulting from the dumbbell 106 being dropped, cause the end plate 116 to rotate, and slide laterally relative to the weight assembly 108. This movement, and in particular the rotational movement of the end plate 116, causes the securing member 112 to loosen. Hence, repeated dropping of the dumbbell results in increasing movement of the weight assembly 108 relative to the bar 102 during use, which makes the dumbbell 106 difficult to use effectively. Eventually, this movement results in the end plate 116 becoming detached, creating a hazard to the user. In cases where the end plate is the only means used for retaining the weight assembly, the weight assembly will also become detached, resulting in a serious safety hazard.

To ensure the weight assembly 8 remains secured to the bar 2, it is therefore necessary to obviate, or mitigate against rotation of the end plate 16. Hence, in the present invention there is provided a recess 28 adapted to receive the end plate 16. The recess is formed in the weight assembly 8. Preferably the recess is provided in the outer skin 22 of the weight assembly 8. The outer skin 22 is preferably formed of polyurethane, or any other suitably resilient, mouldable material. The outer skin 22 is formed around the weight member 24, which consists of a dense material such as cast iron, by means of a moulding process. The recess 28 is formed in the outer skin 22 during the moulding process. Providing the recess 28 in the outer skin 22 enables the recess 28 to be conveniently formed during this moulding process.

Figure 2:
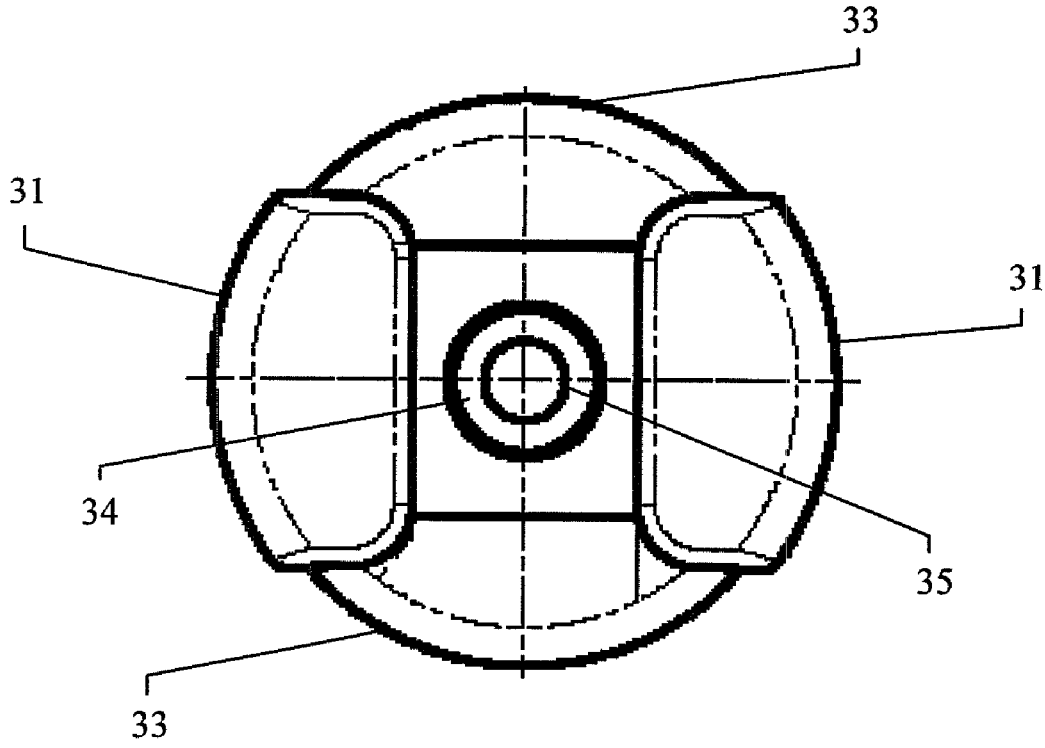
FIG. 2 presents a view of the end plate from above according to an embodiment of the invention.
Figure 4:
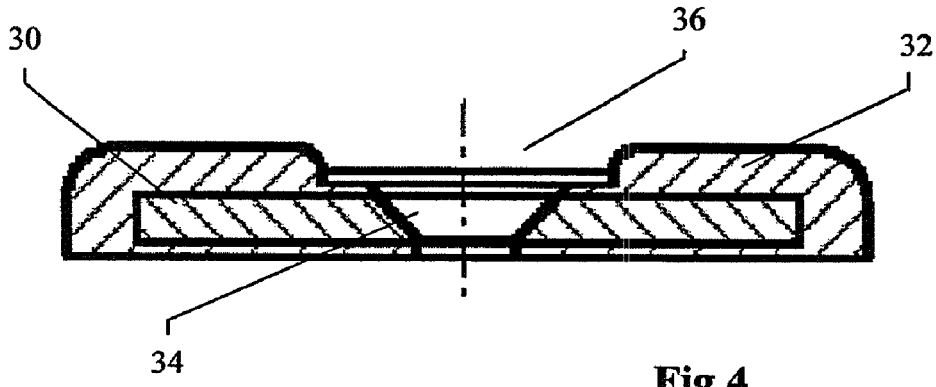
FIG. 4 presents a section view of the end plate according to an embodiment of the invention.

The end plate 16, as shown in FIG. 4, comprises a load bearing plate 30, and an outer skin 32. The outer skin 32 is moulded around the load plate 30 in a similar manner to the weight assembly. From FIG. 2, it can be seen that the end plate 16 comprises a main body 33 and projections 31. In a preferred embodiment, there are provided two projections 31. However, it will be appreciated that a single projection would suffice to prevent rotation. The end plate 16 may also be provided with more than two projections 31.

Preferably, the projections 31 are formed entirely from the outer skin 32, as this enables the projections to be formed during the moulding process, without the requirement to machine the load plate 30 to a corresponding shape. The load plate 30 is preferably circular in shape. However, it could be formed such that it includes corresponding projections, for example by casting of machining.

Figure 3:
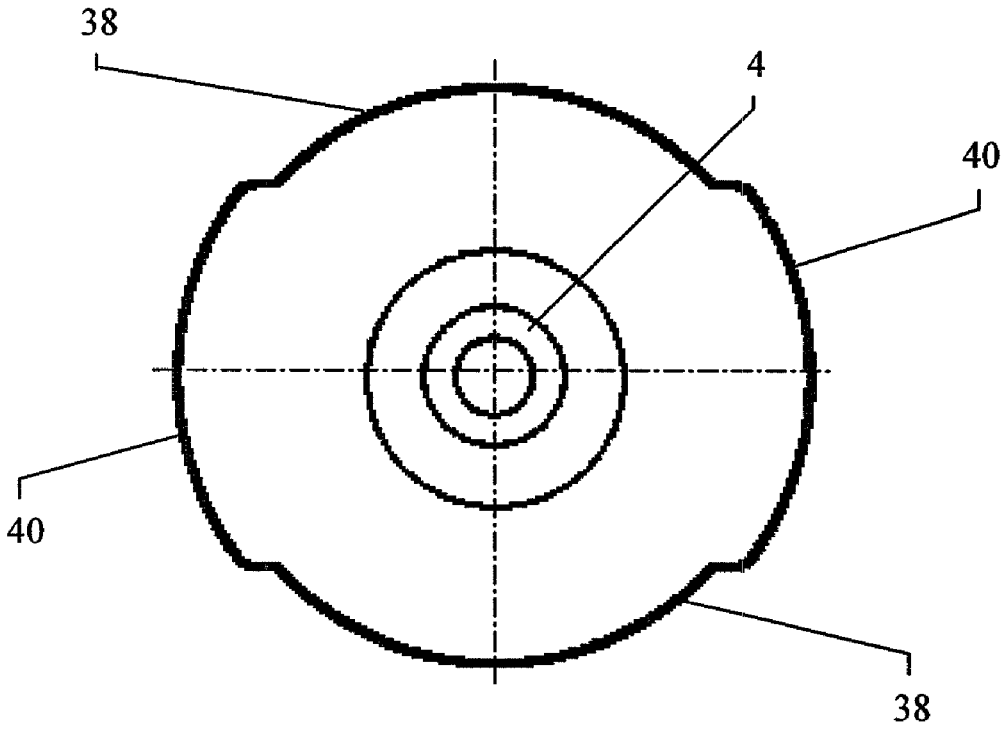
FIG. 3 presents a view from above of the recess according to an embodiment of the invention.

The recess 28 is shaped such that it corresponds in shape to the end plate 16, as can be seen from FIG. 3. The recess 28 is formed having projections 38 corresponding to the diameter of the main body 33 of the end plate 16, and receiving sections 40 corresponding to the projections 31.

To insert the end plate 16 into the recess 28, the end plate is oriented such that projections 31 are located into the receiving sections 40 of the recess 28. Once inserted into the recess 28, rotational movement of the end plate 16 is prevented by the engagement of the projections 31 of the end plate 16 and the receiving sections 40. Lateral or radial movement of the end plate 16 relative to the weight assembly 8 is prevented by the side walls of the recess 28.

The resilient property of the polyurethane outer skins of the weight assembly 8 and the end plate 16 serves to further reduce the effect of the rotational and lateral forces by absorbing these forces on the impact. In addition, the high frictional contact formed between the adjacent polyurethane surfaces of the end plate 16 and the recess 28 serves to further limit relative movement therebetween.

Figure 6:
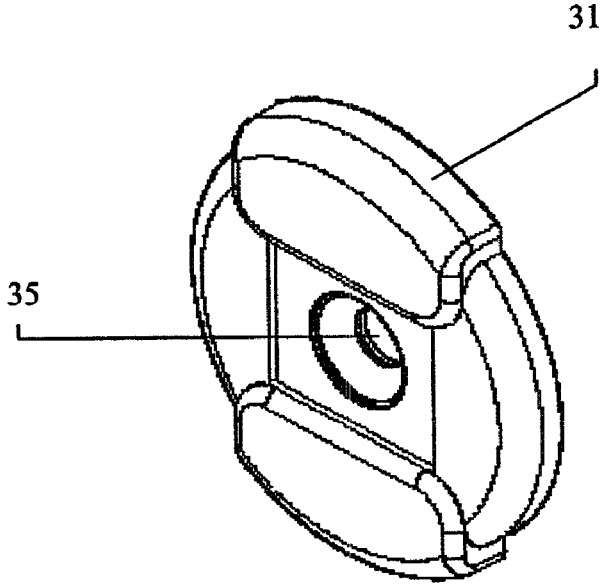
FIG. 6 presents a perspective view of the end plate according to an embodiment of the invention.

As can be seen from FIG. 1, the depth of the recess 28 is less than the thickness of the end plate 16. This enables the end plate 16 to maintain a three dimensional profile above the surface of the weight assembly 8, which assists in removal of the end plate from the recess 28 and also adds to the aesthetics of the dumbbell. FIG. 6 shows a perspective view of the end plate 16 having raised key sections 31. The raised projections may be used to display information such as weight, brand name, logo etc. In addition, a panel (not shown) may be provided in the recess 36 to display similar information. The panel provides the additional advantage of securing the mounting screw 12 from view, and may be secured in position for example using an adhesive.

Figure 5:
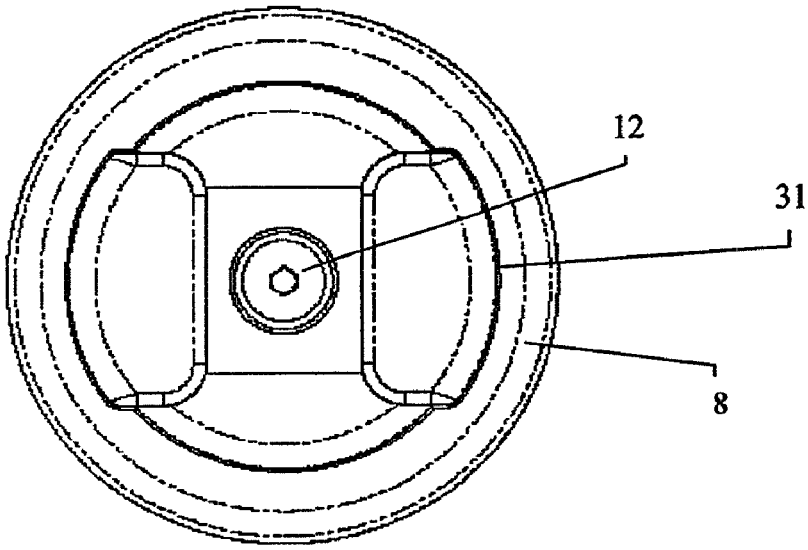
FIG. 5 presents a view from above of the weight assembly and the end plate according to an embodiment of the invention.

In a preferred embodiment, the end plate 16 is substantially circular shape to correspond to the circular shape of the weight assembly 8, as shown in FIG. 5. In an alternative embodiment, the end plate may be a shape other than circular. Where a non-circular end plate is provided, the shape of the end plate may prevent rotation without the requirement for a projection.

In an alternative embodiment, the end plate is provided with spigots extending from the lower surface of the plate. The spigots may be formed from the outer skin during the moulding process. The recess of the weight assembly is provided with apertures corresponding in size and radial position to the spigots of the end plate. When the end plate is inserted into the recess, the spigots are received by the corresponding apertures of the recess, thereby preventing relative rotational and lateral movement between the end plate and the weight assembly. Conversely, the recess of the weight assembly may be provided with mould formed spigots, with corresponding apertures being formed in the lower surface of the end plate.

It will be appreciated that in further embodiments various modifications to the specific arrangements described above and shown in the drawings may be made. For example, it is evident that the construction for securing the weights on the bar is not limited to applications in dumbbells or barbells but can also be applied to secure weights in other exercise equipment applications. Furthermore, whilst it is described that the end plate comprises at least one projection, and the recess comprises at least one receiving section, this arrangement may be reversed, with the recess comprising at least one projection, and the end plate comprising at least one corresponding receiving section.

What is claimed is:

1. An exercise device comprising:

a bar, the bar having an end portion;

a weight assembly mounted on the end portion, the weight assembly including a weight section and an outer skin;

an end plate; and a securing member for co-operating with the end plate to secure the weight assembly to the end portion of the bar;

wherein a recess is formed in the outer skin of the weight assembly and is configured to receive the end plate, and the end plate and the recess are configured such that a portion of the end plate interlocks with a portion of the recess to rotationally fix the end plate relative to the weight assembly.

2. The exercise device of claim 1, wherein the end plate comprises a first engagement element, and the weight assembly comprises a corresponding second engagement element, and wherein the first and second engagement elements, in use, engage to prevent relative rotation between the end plate and the weight assembly.

3. The exercise device of claim 2, wherein the first engagement element comprises at least a portion of the end plate, and the second engagement element comprises at least a portion of the recess.

4. The exercise device of claim 3, wherein the first engagement element comprises at least one projection and the second engagement element comprises at least one receiving section corresponding to the projection.

5. The exercise device of claim 4, wherein the at least one projection is integral with the end plate.

6. The exercise device of claim 4, wherein the end plate comprises a load plate and an end plate outer skin, and the at least one projection is formed by the end plate outer skin.

7. The exercise device of claim 6, wherein the end plate outer skin is moulded over the load plate, the at least one projection being formed by the moulding process.

8. The exercise device of claim 4, wherein the at least one receiving section is formed by the recess.

9. The exercise device of claim 4, wherein the at least one projection includes a radial projection.

10. The exercise device of claim 3, wherein the shape of the end plate defines the first engagement element, and the shape of the recess defines the second engagement element.

11. The exercise device of claim 2, wherein the recess comprises at least one projection defining the second engagement element, and the end plate comprises at least one corresponding receiving defining the first engagement element.

12. The exercise device of claim 1, wherein the outer profile of the end plate and the inner profile of the recess are the same.

13. The exercise device of claim 1, wherein the end plate comprises a pair of radially opposed projections defining the first engagement element, and the recess comprises a pair of receiving sections corresponding to the pair of projections defining the second engagement element.

14. The exercise device of claim 13, wherein the pair of projections include a pair of radial projections.

15. The exercise device of claim 1, wherein the outer skin is moulded over the weight section, with the recess being formed during the moulding process.

16. The exercise device of claim 1, wherein the securing member includes a screw member.

17. The exercise device of claim 16, wherein the end portion comprises an internal threaded portion adapted to receive the screw member.

18. The exercise device of claim 1, further comprising a second securing member for securing the weight assembly to the end portion, wherein the first and second securing members each independently secure the weight assembly to the end portion.

19. The exercise device of claim 1, wherein the exercise device is a dumbbell.

20. The exercise device of claim 1, wherein the recess is adapted to prevent relative lateral movement between the end plate and the weight assembly.

* * * * *